US008003917B2

(12) United States Patent
Kern et al.

(10) Patent No.: US 8,003,917 B2
(45) Date of Patent: Aug. 23, 2011

(54) SEAL FOR A GLOW PLUG

(75) Inventors: Christoph Kern, Aspach (DE); Ewgenji Landes, Remseck (DE); Reiko Zach, Remseck (DE); Michael Kleindl, Schwieberdingen (DE); Christian Doering, Stuttgart (DE); Steffen Schott, Schwieberdingen (DE); Pavlo Saltikov, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 302 days.

(21) Appl. No.: 12/305,054

(22) PCT Filed: Mar. 6, 2008

(86) PCT No.: PCT/EP2008/052720

§ 371 (c)(1),
(2), (4) Date: May 1, 2009

(87) PCT Pub. No.: WO2008/110496

PCT Pub. Date: Sep. 18, 2008

(65) Prior Publication Data

US 2009/0321408 A1 Dec. 31, 2009

(30) Foreign Application Priority Data

| | | |
|---|---|---|
| Mar. 15, 2007 | (DE) | 10 2007 013 127 |
| May 25, 2007 | (DE) | 10 2007 024 393 |
| Feb. 15, 2008 | (DE) | 10 2008 009 429 |

(51) Int. Cl.
*F23Q 7/22* (2006.01)
*F23Q 7/00* (2006.01)

(52) U.S. Cl. ..... 219/270; 219/260

(58) Field of Classification Search ..... 219/270, 219/260, 261, 262, 263, 264, 265, 266, 267, 219/268, 269

See application file for complete search history.

(56) References Cited

U.S. PATENT DOCUMENTS

| | | | | |
|---|---|---|---|---|
| 6,064,039 | A * | 5/2000 | Kumada | 219/270 |
| 6,627,854 | B2 * | 9/2003 | Kumada et al. | 219/270 |
| 7,402,777 | B2 * | 7/2008 | Ron et al. | 219/270 |
| 7,923,662 | B2 * | 4/2011 | Hale et al. | 219/270 |
| 2002/0060214 | A1 * | 5/2002 | Chiba et al. | 219/270 |

FOREIGN PATENT DOCUMENTS

| | | |
|---|---|---|
| DE | 10 2004 043 874 | 10/2006 |
| DE | 10 2005 017 802 | 10/2006 |
| EP | 1 288 573 | 3/2003 |
| JP | 2002-364847 | 12/2002 |

OTHER PUBLICATIONS

International Search Report, PCT/EP2008/052720 dated Jun. 4, 2008.

* cited by examiner

*Primary Examiner* — Daniel Robinson
(74) *Attorney, Agent, or Firm* — Kenyon & Kenyon LLP

(57) ABSTRACT

A glow plug for a combustion chamber of a self-igniting internal combustion engine has a ceramic heating element designed as a sheathed-element glow plug, which is surrounded by a supporting tube. The ceramic heating element is sealed with respect to the combustion chamber of the internal combustion engine by a seal in the supporting tube. The seal is designed as a sealing element made of an FeNi alloy having an Invar effect.

9 Claims, 7 Drawing Sheets

SEAL FOR A GLOW PLUG

FIELD OF THE INVENTION

The present invention is directed to a glow plug.

BACKGROUND INFORMATION

DE 10 2005 017 802 describes a glow plug having a combustion chamber pressure sensor in which a ceramic heating element designed as a sheathed-element glow plug is situated in a housing. The ceramic heating element is surrounded by a supporting tube, which is secured by a seal in the housing. The seal is formed by a graphite ring situated between the supporting tube and the housing.

The mechanical stresses induced by the cyclic thermal stress in actual engine operation impair the adhesion to the interface between the metallic supporting tube and the ceramic heating element, which results in failure of the sealing function due to partial or complete loss of mechanical contact at the interface between the metal and the ceramic.

SUMMARY

Example embodiments of the present invention provide a glow plug having a ceramic heating element in which the interior space is reliably sealed with respect to the combustion chamber gases.

According to example embodiments of the present invention, the glow plug is provided with a sealing element between the ceramic heating element and the metallic supporting tube, the sealing element being made of a metallic alloy with a so-called Invar effect, such alloys having a particularly low value with regard to the coefficient of thermal expansion (CTE). The Invar effect refers to a phenomenon by which a group of alloys and compounds have abnormally low or even negative coefficients of thermal expansion in certain temperature ranges. The use of such a sealing element offers many advantages, in particular an increase in the sealing effect of the sealing element, in particular in critical operating states, as well as avoiding serious changes in mass production design of the ceramic heating element. Due to its particularly good ability to form a continuous material connection, in particular excellent welding properties, a tightly sealed connection to the metallic supporting tube and the ceramic heating element may be implemented. The object of the metallic supporting tube that is used is to attach the ceramic heating element. The ceramic heating element is installed in the supporting tube with a continuous material connection, e.g., via a soldering method. Another function of a supporting tube is to form a long-lasting hermetic seal for sealing a sensor module with respect to the influences of aggressive combustion chamber media, in particular with respect to the high combustion pressures, a buildup of soot and deposits of particles of soot as well as corrosion influences.

An FeNi alloy is used as an alloy having an Invar effect. The FeNi alloys discussed below having a face-centered cubic crystal lattice undergo only very minor or practically no expansion when heated. A ferromagnetic face-centered cubic FeNi alloy is particularly suitable.

With a proposed approach, failure of the sealing function, i.e., complete or partial loss of the mechanical contact at the interface between the metallic material of the supporting tube and the ceramic material of the heating element, is prevented by the fact that an additional sealing element is pressed directly against the ceramic heating element on an end face of the supporting tube on the combustion chamber side and then is attached to the supporting tube by a force-locking or continuous material joint. The sealing element is preferably designed in the form of a ring. With this specific embodiment, a Hertzian pressure on the line of contact between the sealing element and the heating element may be implemented, resulting in a particularly good seal with respect to the aggressive media, in particular the combustion pressures in the combustion chamber.

The proposed sealing element, whether designed in the form of a one-piece or multipiece sleeve, whether designed in a ring shape or as a one-piece component, is preferably made of a material having a coefficient of thermal expansion (CTE) which is below, approaches or is insignificantly higher than the CTE value of the ceramic heating element in the operating temperature range in question here. Such a design of the proposed sealing element has the structural advantage that a press fit implemented between the sealing element and the ceramic heating element increases the pressing force with an increase in temperature, i.e., precisely in the case in which there are also rising pressures to which the glow plug according to example embodiments of the present invention is exposed during operation of an internal combustion engine. In the event of failure of the soldered connection of the ceramic heating element to the supporting tube surrounding it, sealing of the glow plug may nevertheless be ensured during operation of the internal combustion engine because the sealing element designed in the form of a ring or a sleeve ensures the sealing function.

A metal alloy having an Invar effect, known by the brand name KOVAR®, is particularly suitable as the material for the sealing element. This metal alloy has a nickel content of 29.0 wt %, a cobalt content of 17.0 wt %, a silicon content of 0.1 wt % to 0.2 wt %, a manganese content of 0.3 wt % and a carbon content of max. 0.02 wt %; the remainder is iron.

It is also possible to manufacture the sealing element, which is manufactured in a ring shape in one specific embodiment, in the form of a sleeve, such that the sleeve-shaped sealing element is attached to the supporting tube. The butt joint between the sleeve-shaped sealing element and the supporting tube may be designed with inclined faces or with steps.

In addition, the axial positioning of the sealing element, whether designed in the form of a ring or a sleeve, is variable. The position on the ring-shaped end face of the supporting tube, which faces the combustion chamber and surrounds the ceramic heating element, is advantageous in particular because no further modifications in the ceramic heating element are necessary in this case. However, it is also possible to minimally modify the ceramic heating element so that the sealing element assumes any axial position. It is likewise conceivable to position the sealing element in the area of the end of the ceramic heating element facing away from the combustion chamber. A sealing connection between the supporting tube and the sealing element, whether designed in the form of a ring or a sleeve, may be established, for example, by a corresponding continuous material joining method, e.g., a welding or soldering method.

If the sealing element is designed in the form of a sleeve, the complete supporting tube may be manufactured completely from an alloy having an Invar effect. The sealing element is not restricted merely to glow plugs with regard to its application but may also be used on other cylinder head components of internal combustion engines, e.g., glow plugs having integrated pressure sensors or the like.

The present invention is described in greater detail below with reference to the drawings.

DETAILED DESCRIPTION

Figure 1:
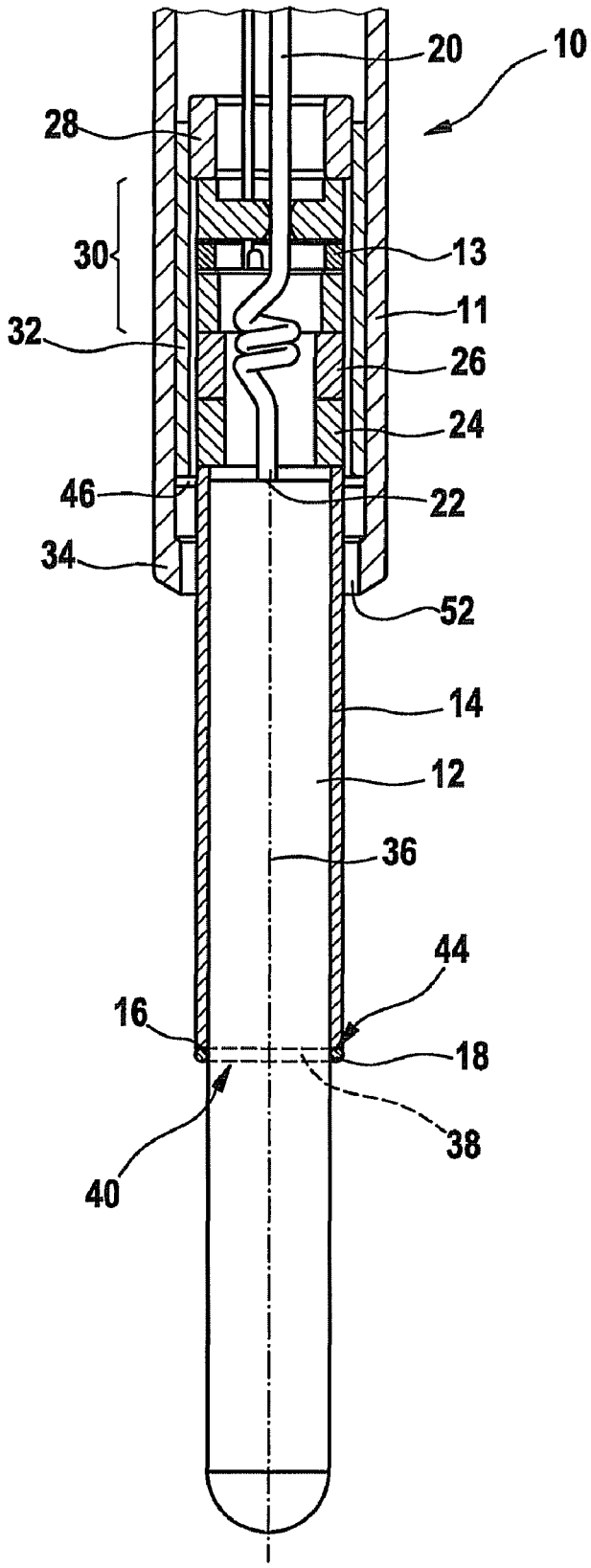
FIG. 1 shows a glow plug having a pressure detecting device in a sectional diagram.

The glow plug shown in FIG. 1, having a pressure detection device, which is referred to below as a pressure measuring glow plug 10, includes a housing 11 into which a ceramic heating element 12 designed as a sheathed-element glow plug and a sensor 13 for detecting the pressure are inserted. Sensor 13 is situated in a sensor module 30. A radially symmetrical metal diaphragm 46, for example, is used to seal a separate premounted sensor module 30. The compressive force exerted on metal diaphragm 46 is converted in a separate pressure measurement module. The pressure measurement module includes a substantially ceramic heating element 12, which is attached in supporting tube 14, a compensation element 24 and a thermal insulation and force transfer element 26 as well as a separate sensor module 30, a fixation element 28, above-mentioned radially symmetrical metal diaphragm 46 and a sensor cage 32.

When acted upon by a pressure, e.g., the pressure prevailing in the cylinder of an internal combustion engine, ceramic heating element 12 functions as the transmission element of the compressive force in the combustion chamber to sensor module 30. Ceramic heating element 12 is movement-coupled to metal diaphragm 46 via supporting tube 14. The force acting on ceramic heating element 12 is transmitted to sensor module 30 via the force path. Compensation element 24 is preferably manufactured from a material having a specially adapted value of the coefficient of thermal expansion (CTE) and functions mainly for thermal length compensation at elevated temperatures. Upper thermal insulation and force transmission element 26 has the lowest possible value for thermal conductivity and provides a maximum temperature reduction at sensor module 30. Thermal insulation and compensation element 26 has a very high surface quality and very good rigidity.

Fixation element 28 is downstream from sensor module 30. Sensor module 30 is held together between radially symmetrical metal diaphragm 46 and fixation element 28 by sensor cage 32, which is designed like a sleeve as illustrated in FIG. 1, creating a defined pretension force.

For effective dissipation of heat from sensor module 30, sensor cage 32 is attached by a weld, e.g., as close to the area of a sealing cone 34 as possible. The glow current to ceramic heating element 12 is supplied to it via a glow current line 20. Glow current line 20 at one end face of ceramic heating element 12 is contacted at a contact 22. The axis of symmetry of ceramic heating element 12 is identified by reference numeral 36.

Figure 2:
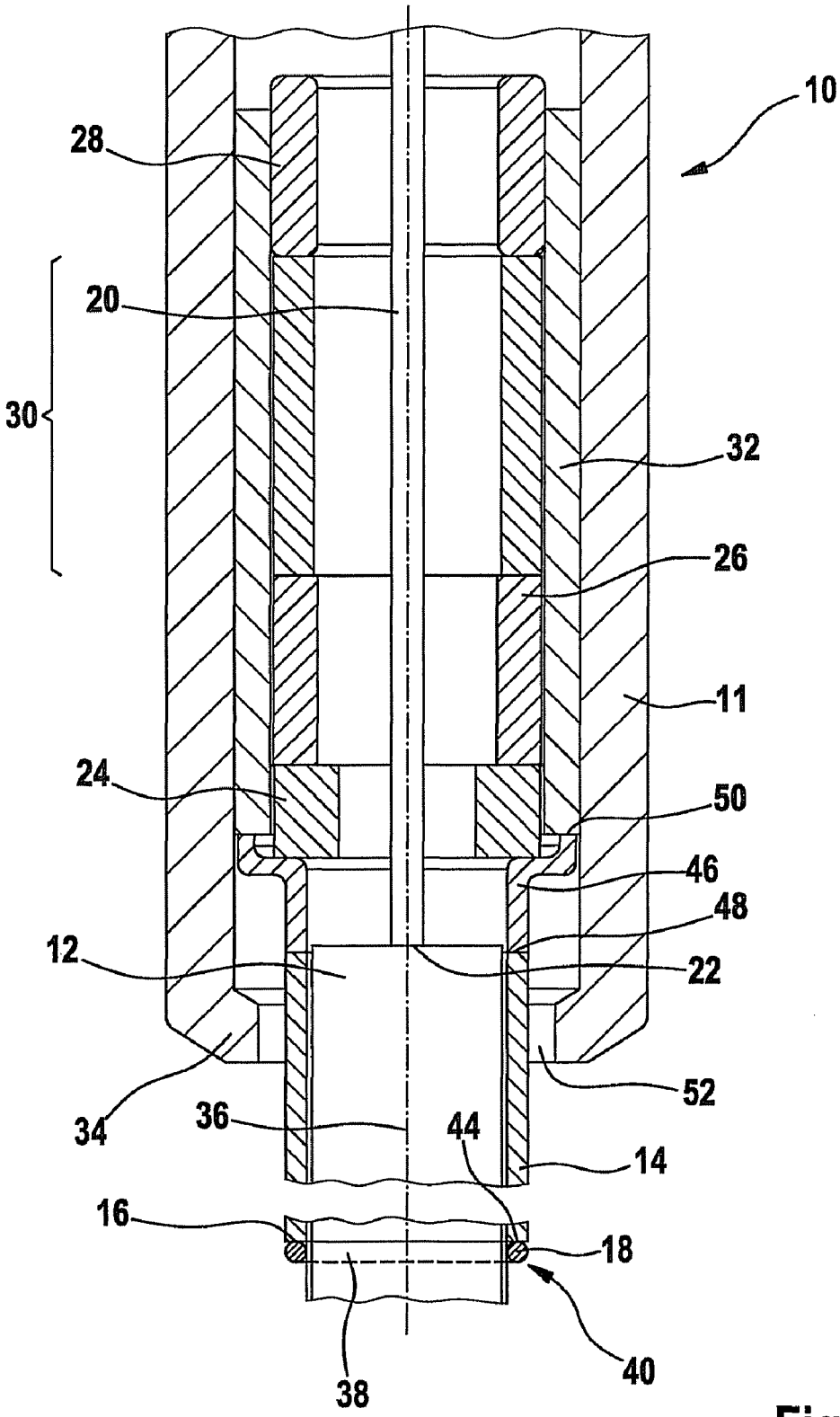
FIG. 2 shows an enlarged diagram of a ceramic heating element beneath a sensor module.

The diagrams according to FIG. 1 and FIG. 2 show that a sealing element 40 designed in the form of a ring 18 is situated on supporting tube 14, which is designed here in one piece, on an end face 16 on the combustion chamber side. Sealing element 40, designed here in the form of a ring 18, is attached by a shrink fit 38 to the circumferential surface of ceramic heating element 12. A force-locking or continuous material connection 44 is then created on end face 16 facing the combustion chamber of supporting tube 14 designed in one or more parts. In this specific embodiment, a Hertzian pressure may be implemented on the line of contact between sealing element 40, which is designed in ring form 18, and the lateral surface of ceramic heating element 12 at shrink fit 38, thus achieving a particularly good seal with respect to the combustion chamber of the internal combustion engine.

Supporting tube 14, which is manufactured from a metallic material, has the function of attaching ceramic heating element 12. As a rule, ceramic heating element 12 is accommodated in a material connection, e.g., in a soldered connection in supporting tube 14. The soldered connection functions, firstly, to attach and seal ceramic heating element 12 within supporting tube 14 and, secondly, to establish electrical contact with ceramic heating element 12 within supporting tube 14. An additional function of supporting tube 14 is to provide a long-lasting hermetic seal of sensor module 30 with respect to the influences of aggressive combustion chamber media, in particular with respect to high combustion pressures, with respect to soot buildup and deposits of soot particles as well as corrosion effects. In practice, ceramic heating element 12 is manufactured from a ceramic having a relatively low coefficient of thermal expansion (CTE), while the material of supporting tube 14 itself has a comparatively higher CTE value (steel). Sealing element 40, whether designed in the form of a ring 18 or in the form of a sleeve, is preferably manufactured from a material having a CTE value which is below, approaches, or only insignificantly exceeds the CTE value of ceramic heating element 12 in the relevant operating temperature range. Such a combination of properties of the material has the constructive advantage that press fit 38 between sealing element 40 in ring form 18 and ceramic heating element 12 increases with an increase in temperature. If the solder breaks between the lateral surface of ceramic heating element 12 and the inner jacket of supporting tube 14, the seal of pressure measuring glow plug 10 is still ensured by sealing element 40 in ring form 18.

Metal alloys having a so-called Invar effect may be considered as the material for sealing element 40, whether designed in sleeve form or in ring form 18. These alloys are characterized in particular by an almost constant invariant thermal expansion as a function of temperature in a large temperature range.

As FIG. 2 indicates, pressure measuring glow plug 10 includes metal diaphragm 46 above supporting tube 14 designed in one or more parts. Metal diaphragm 46 is designed to be essentially radially symmetrical and forms a first butt joint 48 to supporting tube 14, designed in one or more parts, and a second butt joint 50 to sensor cage 32, which is designed in the form of a sleeve in this example embodiment. Sensor cage 32 in turn surrounds fixation element 28, thermal insulation and force transmission element 26 and compensation element 24. FIG. 2 shows that the upper end face of ceramic heating element 12 is electrically contacted at contact 22 by glow current line 20. Glow current line 20 may run substantially in a straight line, as shown in FIG. 2, but it may also include one or more coil-shaped windings, depending on the intended purpose.

Sensor cage 32 surrounds sensor module 30, which cooperates with compensation element 24 and thermal insulation and force transmission element 26 in the example embodiment shown in FIG. 2. Sensor module 30 may be designed as a piezoelectric or piezoresistive sensor module for pressure measurement, for example.

FIG. 2 also shows that the body of pressure measuring glow plug 10 surrounds an opening 52 through which supporting tube 14 passes. Ceramic heating element 12 is in the interior of supporting tube 14. Ceramic heating element 12, shown partially in FIG. 2, is surrounded by a soldered connection along its axial extent in supporting tube 14. In FIG. 2, end face 16 on the combustion chamber side of supporting tube 14, designed in one or more parts, is indicated, and sealing element 40 in ring form 18 is in contact with it. Sealing element 40 is in contact with shrink fit 38 on the lateral surface of ceramic heating element 12 on the one hand and on the other hand is connected to end face 16 on the combustion chamber side of supporting tube 14 via continuous material connection 44 mentioned already in conjunction with FIG. 1. Ceramic heating element 12 is sealed by sealing element 40 situated on end face 16 on the combustion chamber side of supporting tube 14, designed in one or more parts. This sealing element is attached to end face 16 on the combustion chamber side of supporting tube 14 designed in one or more parts via a force-locking or continuous material joint 44.

According to example embodiments of the present invention, sealing element 40 is made of a material having a CTE value which is below, approaches, or only insignificantly exceeds the CTE value of ceramic heating element 12 in the relevant operating temperature range. Such a combination of properties has the constructive advantage that the press fit at shrink fit 38 between sealing element 40 and ceramic heating element 12 increases with an increase in temperature. The seal of the pressure detection device may thus be ensured by sealing element 40 in the event of failure, e.g., in breakage of the soldered connection between the lateral surface of ceramic heating element 12 and the inside of supporting tube 14, and functions reliably at both high and low operating temperatures. A metal alloy having an Invar effect is used as the material for sealing element 40. The basic alloy having this property is a ferromagnetic face-centered cubic FeNi alloy having a stoichiometric ratio of approximately $Fe_{65}Ni_{35}$. This alloy is characterized by an almost constant invariant thermal expansion as a function of temperature over a wide temperature range.

Figure 4:
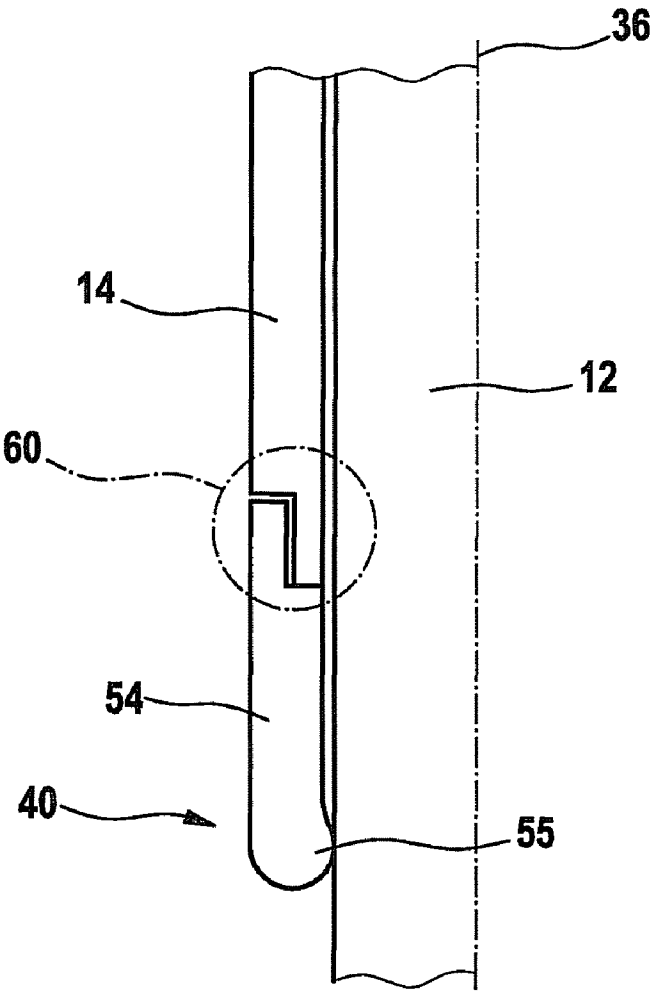
FIG. 4 shows an example embodiment of the butt joints of the two parts of the sealing element designed in the form of a sleeve.
Figure 3:
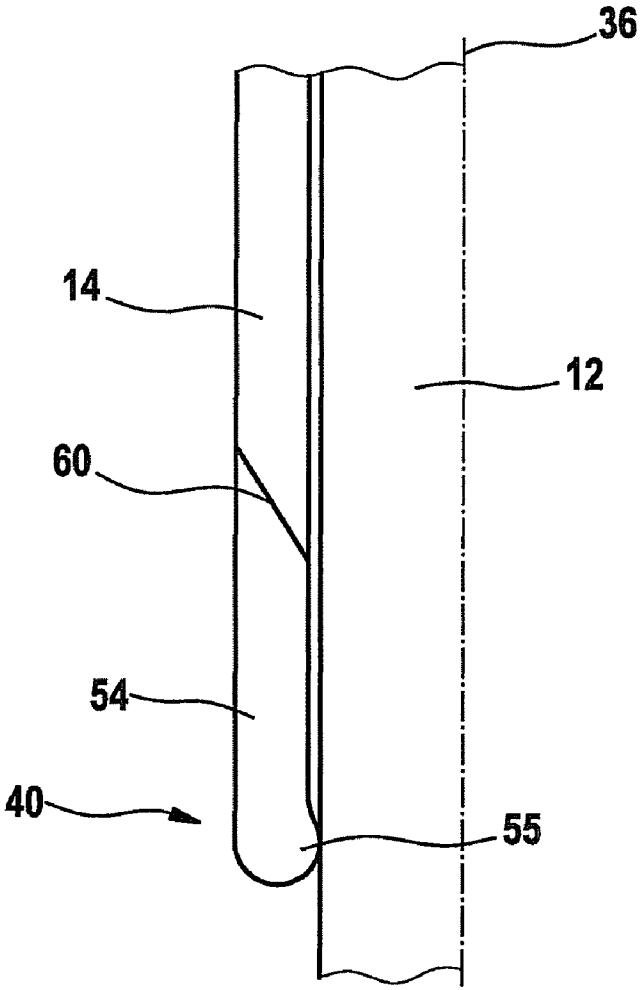
FIG. 3 shows an example embodiment of a butt joint of a sealing element designed in the form of a sleeve in two parts.

The diagrams according to FIGS. 3 and 4 show additional example embodiments of sealing element 40. As shown by the diagrams in FIGS. 3 and 4, sealing element 40 may also be designed as sleeve 54, in contrast with the diagrams in FIGS. 1 and 2, as described above. Supporting tube 14 and sleeve 54 are attached to one another at a butt joint 60. The diagram according to FIG. 3 shows that butt joint 60 between sleeve 54 and supporting tube 14 may include at least one or more inclinations, resulting in the configuration of an inclined butt joint 60 as shown in FIG. 3. Butt joint 60 designed with inclinations improves the ability to form a continuous material joint, in particular weldability during manufacturing. If, as shown in FIG. 3, a sleeve 54 having an internal profile 55 is used, an increased Hertzian pressure on the line of contact on the circumference of ceramic heating element 12 is implementable. This improves the sealing effect. Furthermore, additional sealing may be achieved by the continuous material connection formed at butt joint 60.

On the other hand, butt joint 60 between sealing element 54 and supporting tube 14 may also be designed in the form of a step, as illustrated in FIG. 4. The example embodiment of butt joint 60 illustrated in FIG. 4 provides the step on supporting tube 14, which is lengthened in the axial direction and engages in a correspondingly configured inner recess in sleeve 54. With a sleeve 54 having internal profile 55, an improved Hertzian pressure at the line of contact on the circumference of ceramic heating element 12 may be achieved.

The metallic alloy having an Invar effect may be one of the basic alloys indicated below. Fe-36Ni, known in general as Invar, as well as Fe-32Ni-5Co, which is generally known as Super Invar, may be mentioned. In addition, Fe-29Ni-17Co, known in general as Kovar®, may also be used, as well as Fe-42Ni—Cr—Ti, which is known in general as Ni-Span-C. The individual components of these alloys vary within wide limits (the following amounts are given in wt %:

The following concentration ranges apply to the aforementioned alloys Fe-36Ni, Fe—Ni42 and Fe—Ni43, which are known in general as Invar: Ni from 35.0 to 44.0 wt %, Mn<1.0 wt %, Si<0.50 wt % and C<0.10 wt %, remainder Fe.

For the basic alloy Fe-32Ni-5Co, which is also listed above and is known in general as Super Invar, the following concentration ranges apply: Ni from 31.0 to 33.0 wt %, Co from 4.0 to 6.0 wt %, Mn<0.50 wt % and Si<0.50 wt %, C<0.10 wt %, remainder Fe.

For Fe-29Ni-17Co, which is known in general as Kovar, the following concentration ranges apply: Ni from 28.0 to 30.0 wt %, Co from 17.0 to 18.0 wt %, Mn<0.50 wt %, Si<0.30 wt % and C<0.05 wt %, remainder Fe.

Finally, the following composition applies to basic alloy Fe-42Ni—Cr—Ti, known in general as Ni-Span-C: Ni from 41.0 to 43.0 wt %, Co from 6.0 to 7.0 wt %, Mn<1.0 wt %, Si<0.50 wt % and C<0.10 wt %, remainder Fe.

The following table lists the CTE guideline values for the KOVAR® alloy and for conventionally used steels, e.g., ferritic steels, and heating ceramics (for example, based on silicon nitride). The table shows that a definite reduction in the CTE difference at the interface may be achieved by using this alloy instead of the steel. For certain combinations of material, a good seal may be achieved in particular at higher temperatures, such as those which occur during operation of an internal combustion engine.

TABLE

CTE values ($\times 10^{-6}$ $K^{-1}$) for metal alloys and ceramics

| T (° C.) | $\alpha_{KOVAR®}$ | $\alpha_{steel}$ | $\alpha_{Si_3N_4}$ | $\alpha_{KOVAR®} - \alpha_{Si_3N_4}$ | $\alpha_{steel} - \alpha_{Si_3N_4}$ |
|---|---|---|---|---|---|
| 300 | 5.1 | 10.5 | 5.0 | 0.1 | 5.5 |
| 400 | 4.9 | 10.5 | 5.4 | −0.5 | 5.1 |
| 450 | 5.3 | 11.0 | 5.6 | −0.3 | 5.4 |
| 500 | 6.2 | 11.0 | 5.8 | 0.4 | 5.2 |

Column 4 of the table above ($\alpha_{KOVAR®}$-$\alpha_{Si_3N_4}$) shows that at temperatures of 400° C., for example, there is a negative difference of $-0.5\times10^{-6}$ $K^{-1}$ between the two CTE values, and at a temperature of 450° C. there is a difference in CTE values between Fe-29Ni-17Co (KOVAR®) and ceramic of $-0.3\times10^{-6}$ $K^{-1}$. Since the differences between the two CTE values listed in column 4 are extremely small and may even assume negative values with regard to the temperatures of 400° C. and 450° C., a particularly good seal that is stable even at elevated temperatures may be achieved by using these materials for sealing. Column 5 shows differences between $\alpha_{steel}$ and $\alpha_{Si_3N_4}$ of 5.1 to $5.4\times10^{-6}$ $K^{-1}$ for temperatures of 400° C. and 450° C., because when using conventional steels as sealing elements in ceramic heating elements 12, much greater differences between CTE values occur, which suggests a far inferior seal—in comparison with the values given in column 4.

Figure 5:
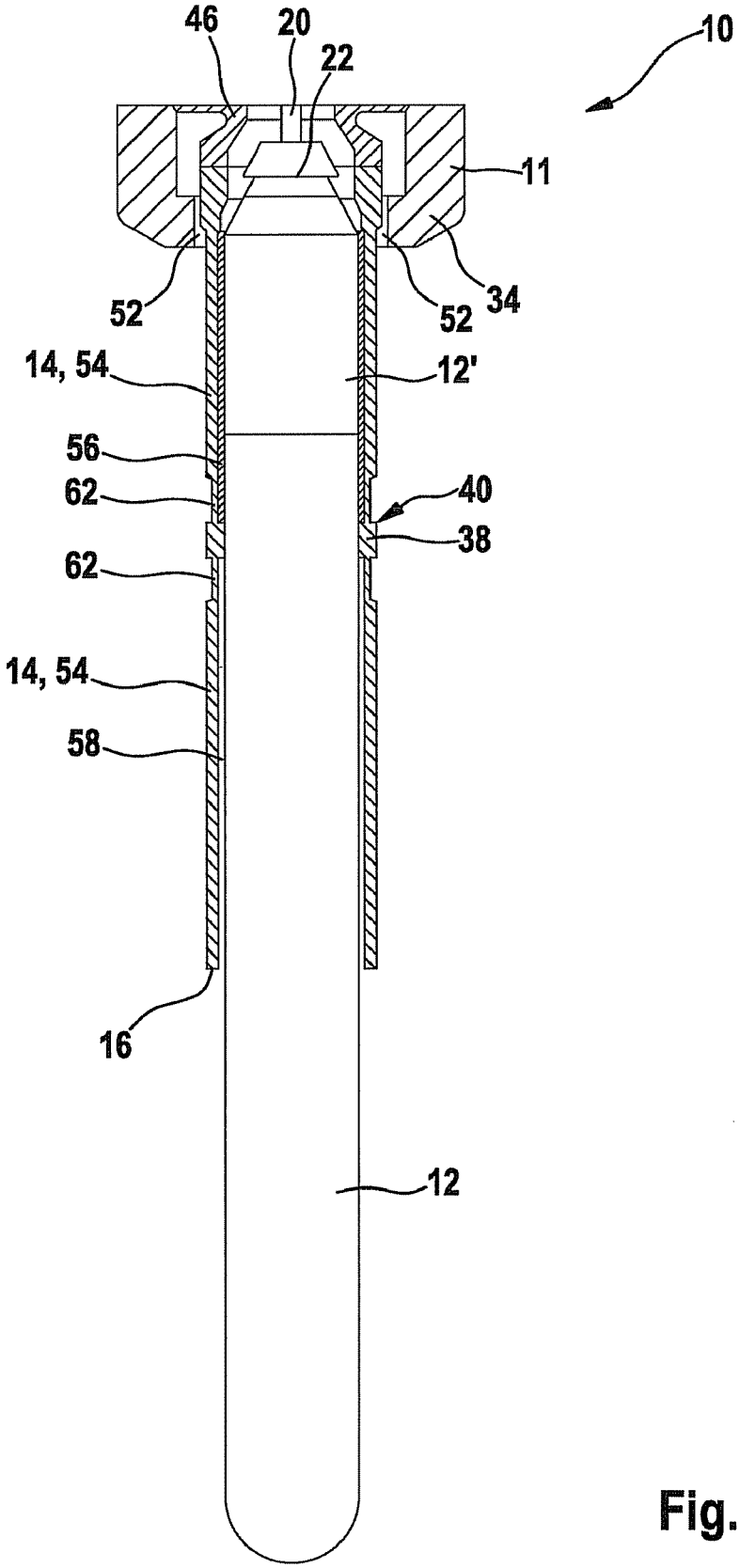
FIG. 5 shows an example embodiment of the sealing of the glow plug by designing a press fit and a supporting tube having a reduced wall thickness.

As shown in the diagram according to FIG. 5, sealing of pressure measuring glow plug 10 may also be implemented via supporting tube 14 alone. Supporting tube 14, made of Fe-29Ni-17Co, for example, has two neighboring sections 62 of a reduced wall thickness in an area 12' facing away from the combustion chamber. Between these sections 62 there is another section forming a shrink fit 38 with ceramic heating element 12, such that shrink fit 38 forms sealing element 40 at this location. Supporting tube 14 is in contact with metal diaphragm 46, preferably designed to be radially symmetrical, and in turn surrounding glow current line 20 and its contact 22 on ceramic heating element 12. Supporting tube 14 and ceramic heating element 12 are joined together in area 12' near the plug body, e.g., via a soldered connection 56. Soldered connection 56 constitutes the electrical contact of ceramic heating element 12 and its attachment in supporting tube 14. In the area of supporting tube 14 remote from the plug body, a clearance 58 is formed between the inside circumferential surface of supporting tube 14 and the lateral surface of ceramic heating element 12, the clearance being filled with solder 56 in this area 12' above shrink fit 38.

Figure 6:
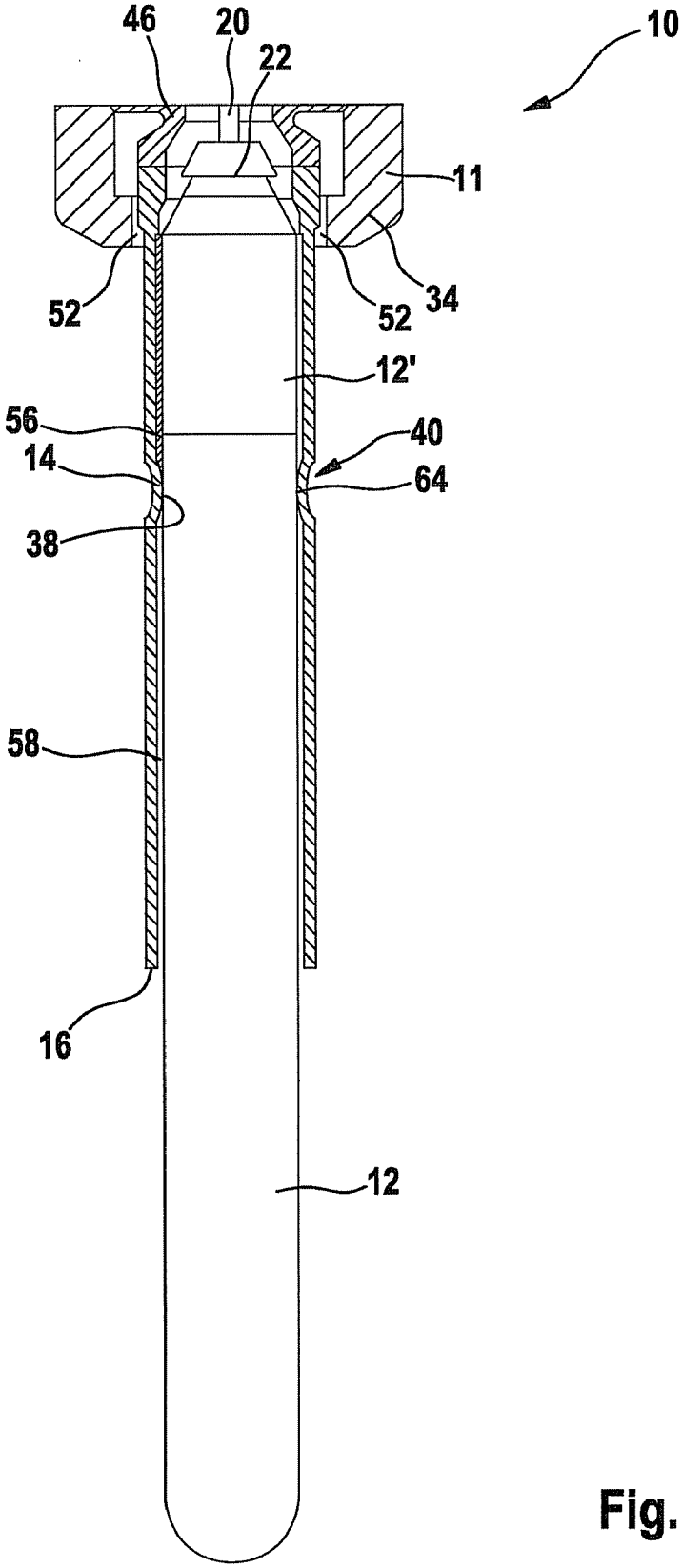
FIG. 6 shows the design of the sealing of the glow plug by designing at least one crease in the supporting tube.

The diagram in FIG. 6 illustrates an example embodiment of the design of the sealing of pressure measuring glow plug 10. FIG. 6 shows that pressure measuring glow plug 10 surrounds a sealing cone 34. Supporting tube 14, preferably made of a metallic alloy, e.g., Fe-29Ni-17Co, is accommodated inside sealing cone 34. Supporting tube 14 is adjacent to metal diaphragm 46, which is preferably designed to be radially symmetrical and surrounds contact 22 as well as glow current line 20. Supporting tube 14 forms a clearance in the upper area of ceramic heating element 12 with respect to its lateral surface, the clearance being filled with solder 56. The example embodiment according to FIG. 6 shows that at least one peripheral crease 64 extends in the axial direction of supporting tube 14. The filling of solder 56, which provides electrical contact for ceramic heating element 12, extends to above peripheral crease 64. Shrink fit 38 between the lateral surface of ceramic heating element 12 and the inside lateral surface of supporting tube 14 is formed by at least one peripheral crease 64. A local press fit having a smooth course of the joint pressure in the direction of the edge of press fit 38 with ceramic heating element 12 may be achieved by at least one peripheral crease 64 on the circumference of supporting tube 14. Sealing element 40 between supporting tube 14 and ceramic heating element 12 is formed by at least one crease 64 in supporting tube 14.

Figure 7:
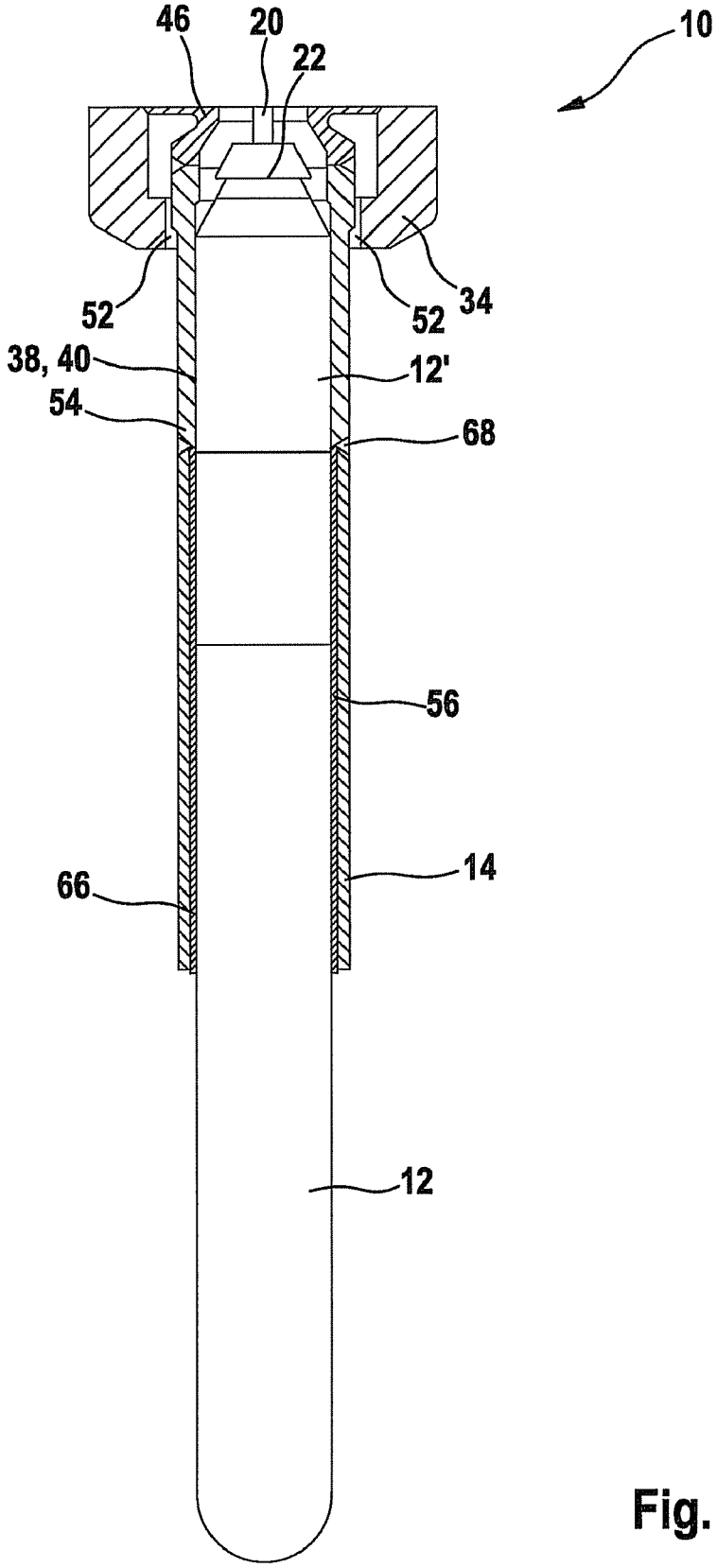
FIG. 7 shows a sleeve-shaped sealing element joined to the supporting tube in a continuous material connection.

The diagram according to FIG. 7 illustrates an example embodiment of pressure measuring glow plug 10. The configuration according to FIG. 7 indicates that pressure measuring glow plug 10 includes sleeve 54, which is attached in the area of sealing cone 34 in the plug body of pressure measuring glow plug 10. Sleeve 54, which is made of Fe-29Ni-17Co, for example, is situated in area 12' facing away from the combustion chamber. Sleeve 54 is adjacent to metal diaphragm 46, which is preferably designed to be radially symmetrical and in turn surrounds contact 22 and glow current line 20. Supporting tube 14, which is made of conventional steel, is joined in a continuous material connection at a connection point 68 to sleeve 54, which is made of a material having an Invar effect, e.g., Fe-29Ni-17Co. Whereas shrink fit 38 is designed as a sealing element 40 in the form of a press fit to ensure the seal between sleeve 54 and the circumferential surface of ceramic heating element 12 over the axial extent of sleeve 54, a clearance 66 filled with solder is provided between supporting tube 14 and the lateral surface of ceramic heating element 12.

Figure 8:
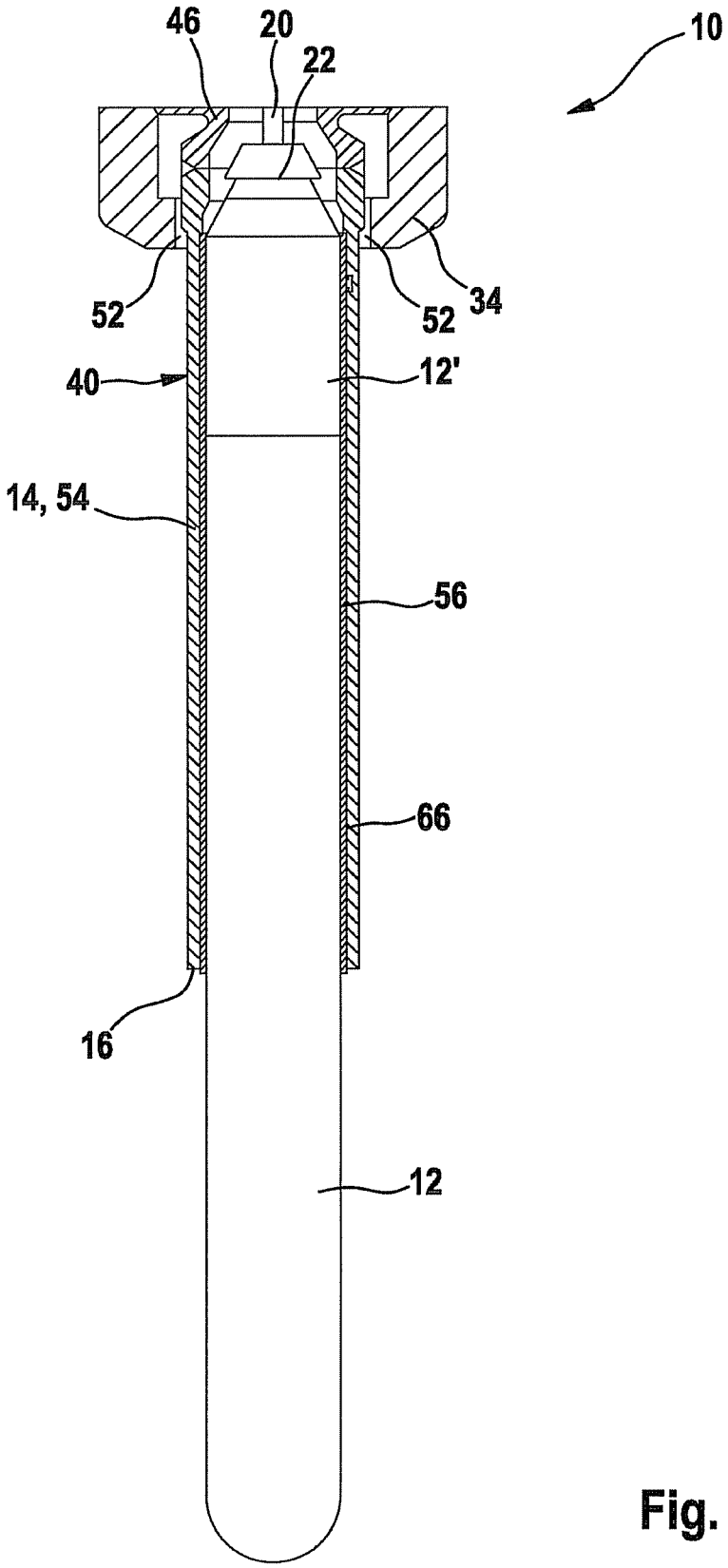
FIG. 8 shows the sealing of the glow plug by a continuous supporting tube, its clearance being filled with solder, for example, to receive the ceramic element heating.

Finally, the diagram according to FIG. 8 shows a design of the sealing of pressure measuring glow plug 10 in which ceramic heating element 12 is surrounded by supporting tube 14, and clearance 66 filled with solder is situated between the lateral surface of ceramic heating element 12 and the inside circumferential surface of supporting tube 14. As also shown by the diagram according to FIG. 8, supporting tube 14 is secured in opening 52 of sealing cone 34 of the plug body of pressure measuring glow plug 10 and is adjacent to a metal diaphragm 46, preferably designed to be radially symmetrical. Metal diaphragm 46, which is preferably designed to be radially symmetrical, in turn surrounds contact 22 in which glow current line 20 is connected to the upper end face of ceramic heating element 12. According to the example embodiment of pressure measuring glow plug 10 illustrated in FIG. 8, supporting tube 14 is preferably made of Fe-29Ni-17Co or the basic alloys mentioned above and has a lower coefficient of thermal expansion (CTE) in rear area 12'. The lowest thermally induced differences in length between the metallic material and ceramic heating element 12 occur in area 12' on the end of ceramic heating element 12 facing away from the tip of ceramic heating element 12, so that sleeve 54 is designed as sealing element 40 because of the temperature distribution there. Although temperatures of approximately 200° C. to 300° C. are reached on end 12' of ceramic heating element 12 facing away from the combustion chamber, the temperature on end 12' of supporting tube 10 facing the combustion chamber is between 600° C. and 700° C. Through the specific embodiment illustrated in FIG. 8, it is thus possible to achieve the result that in the area of supporting tube 14, which is exposed to the higher temperatures in the combustion chamber, the sealing effect between supporting tube 14, which serves as a sealing element 54 here, in the rear area, i.e., area 12' facing away from the combustion chamber, is maintained at the location where lower temperatures between 200° C. and 300° C. prevail.

What is claimed is:

1. A glow plug, comprising:

a ceramic heating element arranged as a sheathed-element glow plug situated in a housing and surrounded by a supporting tube, the ceramic heating element being sealed in the supporting tube by a seal with respect to a combustion chamber, and the seal being arranged as a sealing element manufactured from an alloy having an Invar effect;

wherein the alloy having the Invar effect is a face-centered cubic FeNi alloy having at least one of the following concentration ranges:

(a) Ni from 35.0 to 44.0 wt %, Mn <1.0 wt %, Si <0.50 wt % and C <0.10 wt %, remainder Fe;

(b) Ni from 31.0 to 33.0 wt %, Co from 4.0 to 6.0 wt %, Mn <0.50 wt % and Si <0.50 wt %, C <0.10 wt %, remainder Fe;

(c) Ni from 28.0 to 30.0 wt %, Co from 17.0 to 18.0 wt %, Mn <0.50 wt %, Si <0.30 wt % and C <0.05 wt %, remainder Fe; and (d) Ni from 41.0 to 43.0 wt %, Co from 6.0 to 7.0 wt %, Mn <1.0 wt %, Si <0.50 Wt % and C <0.10 wt %, remainder Fe.

2. The glow plug according to claim 1, wherein the sealing element has a ring shape, is secured on a lateral surface of the ceramic heating element via a shrink fit and is connected to an end face of the supporting tube by a continuous material connection.

3. The glow plug according to claim 1, wherein the sealing element is a sleeve-shaped sealing element, which is connected to the supporting tube at a butt joint and is secured to a lateral surface of the ceramic heating element via a shrink fit.

4. The glow plug according to claim 3, wherein the butt joint between the sleeve-shaped sealing element and the supporting tube is arranged as at least one of (a) a conical and (b) a step-shaped butt joint.

5. The glow plug according to claim 1, wherein the sealing element is a sleeve-shaped sealing element, and the sleeve-shaped sealing element and the supporting tube are arranged as a single component having two neighboring sections of a reduced wall thickness, between which a ring section is formed, creating a shrink fit with the ceramic heating element as a sealing element.

6. The glow plug according to claim 1, wherein the sealing element is a sleeve-shaped sealing element, and the sleeve-shaped sealing element and the supporting tube are arranged as a single component having at least one peripheral crease forming a shrink fit with the ceramic heating element as a sealing element.

7. The glow plug according to claim 1, wherein the sealing element is a sleeve-shaped sealing element, the sleeve-shaped sealing element and the supporting tube are arranged as a single component; and the sleeve-shaped sealing element forms the sealing element on a section of the heating element facing away from the combustion chamber.

8. The glow plug according to claim 1, wherein the housing has a hollow space in which a sensor module is situated next to the sheathed-element glow plug, and the hollow space is sealed with respect to the combustion chamber by a metal diaphragm arranged to be substantially radially symmetrical.

9. The glow plug according to claim 8, wherein the sensor module includes a pressure sensor.

* * * * *